US008547529B2

(12) United States Patent
Brommer

(10) Patent No.: US 8,547,529 B2
(45) Date of Patent: Oct. 1, 2013

(54) METHOD AND APPARATUS FOR COUNTERMEASURING AN INFRARED SEEKING MISSILE UTILIZING A MULTISPECTRAL EMISSIVE FILM

(75) Inventor: Karl D. Brommer, Exeter, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 379 days.

(21) Appl. No.: 12/932,187

(22) Filed: Feb. 18, 2011

(65) Prior Publication Data

US 2012/0211678 A1 Aug. 23, 2012

(51) Int. Cl.
*G01C 3/08* (2006.01)

(52) U.S. Cl.
USPC ..... 356/3.01; 356/3.1; 356/4.01; 356/5.01

(58) Field of Classification Search
USPC ..... 356/3.01–3.15, 4.01–4.1, 5.01–5.15, 356/6–22, 28, 28.5, 139.01–139.1
See application file for complete search history.

(56) References Cited

U.S. PATENT DOCUMENTS 7,378,626 B2 5/2008 Fetterly
7,446,315 B1 * 11/2008 Tidwell ..... 250/338.1

* cited by examiner

*Primary Examiner* — Luke Ratcliffe
(74) *Attorney, Agent, or Firm* — Robert K. Tendler

(57) ABSTRACT

An electronic countermeasures product includes flexible packaging of diodes that operate in the infrared portion of the electromagnetic spectrum to replace flares, lamps and directed lasers with an inexpensive easily deployed countermeasure systems.

20 Claims, 11 Drawing Sheets

Diode Sources

| λ-μ | Δλ-nm | Δθ-deg | Die-mm | a-mm | Po-mW | Ii-mA | VI-V | Pi-mW | Po/Pi | u-mW/cm^2 | A100-cm^2 | L100-cm | Diodes/100W | Part | Source | | | |
|---|---|---|---|---|---|---|---|---|---|---|---|---|---|---|---|---|---|---|
| 0.85 | 40 | 26 | 1 | 3 | 26 | 50 | 1.5 | 75 | 0.3487 | 289 | 348 | 19 | 3 846 | LED850-03UP | roithnor-laser.com | | | |
| 1.46 | 150 | 20 | 1 | 3 | 1.8 | 20 | 0.8 | 16 | 0.1125 | 20 | 6000 | 71 | 55 556 | ELD1480-525 | roithnor-laser.com | | | |
| 3.4 | 70 | 10 | 1 | 3 | 0.02 | 200 | 1 | 200 | 0.0001 | 0.2 | 460000 | 671 | 5 000 000 | LED34-PR | roithnor-laser.com | Inadequate power density | | |
| 3.8 | 702 | 60 | 0.1 | 0.12 | 0.7 | 50 | 2 | 100 | 0.007 | 4861 | 21 | 5 | 142 857 | Soo Das et al | Das and Chaung, ARL | put all Das and Chang refs here and put on chart | | |
| | | | | | | | | | | | | | | | | | | |
| | | | | | | | | | | Legend | | | | | | | | |
| | | | | | | | | | | λ-μ | peak radiated wavelength in microns | | | | | | | |
| | | | | | | | | | | Δλ-nm | radiated bandwidth in nanometers | | | | | | | |
| | | | | | | | | | | Δθ-deg | bandwidth in degrees | | | | | | | |
| | | | | | | | | | | Die-mm | die size in millimeters | | | | | | | |
| | | | | | | | | | | a-mm | lattice constant in millimeters | | | | | | | |
| | | | | | | | | | | Po-mW | output power in milliwatts | | | | | | | |
| | | | | | | | | | | Ii-mA | input current in milliwatts | | | | | | | |
| | | | | | | | | | | VI-V | input voltage in volts | | | | | | | |
| | | | | | | | | | | Pi-mW | input power in milliwatts | | | | | | | |
| | | | | | | | | | | Po/Pi | efficiency | | | | | | | |
| | | | | | | | | | | u-mW/cm^2 | radiated areal power density in milliwatts per square centimeters | | | | | | | |
| | | | | | | | | | | A100-cm^2 | area necessary to radiate 100W in square centimeters | | | | | | | |
| | | | | | | | | | | L100-cm | length of 100W square patch in cm | | | | | | | |
| | | | | | | | | | | | | | | | | | | |
| | | | | | | | | | | References | | | | | | | | |
| | | | | | | | | | | Das et al | Performance of 64x64 MWIR Supper lattice Light Emitting Diode (SLED) array for IR scene generation - gives array dimensions | | | | | | | |
| | | | | | | | | | | Das et al | IEEE transaction, Flip Chip Bonding of 68 68 MWIR LED Arrays | | | | | | | |
| | | | | | | | | | | Das et al | Techniques to Improve MWIR Light Emitting Diode Emission Power | | | | | | | |
| | | | | | | | | | | Das et al | Applied Physics Letter on record (-1%) efficiency | | | | | | | |
| | | | | | | | | | | | | | | | | | | |

Fig. 15

METHOD AND APPARATUS FOR COUNTERMEASURING AN INFRARED SEEKING MISSILE UTILIZING A MULTISPECTRAL EMISSIVE FILM

FIELD OF THE INVENTION

This invention relates to a method and apparatus for countermeasuring infrared seeking missiles and more particularly to the utilization of thin flexible plastic lighting sources in the form of an inexpensive adhesive mini-panel or patch to be mounted conformally on an aircraft or other vehicle to generate jamming infrared radiation in missile seeker bands comparable to that associated with high intensity infrared laser sources.

BACKGROUND OF THE INVENTION

Currently, in the field of countermeasuring manpad missiles, those missiles having seeker heads which detect infrared radiation from the engines of an aircraft, high intensity infrared sources such as lasers mounted on gimbals are utilized to provide radiation coded to spoof the incoming missile so that it moves away from its intended target. It is generally thought that 100 kW per steradian is what is required to jam an incoming missile attacking an aircraft comparable in size to a commercial airliner.

Such countermeasure devices, commonly referred to as directed infrared countermeasures or DIRCM devices are described in U.S. Pat. No. 7,378,626. In general these devices are mounted to the fuselage of an aircraft or helicopter and involve the directing of laser jamming radiation towards an incoming threat. These gimbals and their associated lasers are extremely costly to manufacture and install. Moreover, they require significant maintenance to assure that a laser beam emitted from the gimbal head illuminates the target.

Other methods of countermeasuring an incoming manpad missile include the use of flares which are ejected from the aircraft which act as decoys onto which an incoming missile will home. However once the flares are ejected, the aircraft or vehicle is unprotected, with flares oftentimes being of insufficient intensity to mask the infrared output of massive aircraft engines.

A third way of countermeasuring incoming threats is to utilize a high intensity infrared source or lamp about which a modulator is rotated. In one form the modulator utilizes apertured masks or reflectors. These jamming lamps have outputs which are inherently lower power than that associated with a laser. Moreover, the amount of power necessary to drive such lamps is considerable.

Both the lamp jammers and the DIRCM heads are exceedingly heavy, making their use on unmanned aerial vehicles such as drones problematic due to their weight alone.

In addition, these devices when attached to the outer surface of an airframe generate considerable aerodynamic drag. When deployed these devices significantly increase jet fuel usage and are therefore considered impractical at least from the commercial aviation point of view.

Both their initial installation cost of over a million dollars per aircraft and their maintenance-prone electromechanical nature makes the use of these jammers on commercial aircraft, or indeed on helicopters and smaller private aviation aircraft problematic.

In short, turreted DIRCMs have been cited as being too expensive to install and too costly in terms of fuel usage due to the fact that the DIRCM heads are constantly in the air stream.

There is therefore a need for an extremely simple, inexpensive and rapidly deployable method of protecting aircraft and other vehicles from attack by heat-seeking missiles by being able to project at least on the order of 100 kilowatts per steradian infrared energy onto the seeker head of an incoming missile.

SUMMARY OF INVENTION

In order to solve the problems of countermeasuring manpad missiles especially for commercial aviation as well as in military applications, in one embodiment a thin flexible plastic lighting source is adhered to the skin of an aircraft, with the lighting source including one or more patches of light emitting diodes that emit energy in the infrared region of the electromagnetic spectrum. These patches are formed into a composite panel, with the light from these patches modulated to provide coded jamming pulses that impinge on the seeker of the heat-seeking missile and fool the missile into thinking that the intended target is at a position other than where it actually is.

It has been found that for the 1 micron region of the electromagnetic spectrum standard light emitting diodes are available that have a 10% efficiency. Thus, with a 1-10 kW power source and using the standard diodes and lenses one can produce a 400-1000 watt mini-panel or patch which is capable of providing 100 kW per steradian, clearly enough energy to countermeasure missiles operating in the 1 micron band.

It has also been found that diodes exist having 1% efficiency in the 2-3 micron band which, assuming enough diodes, make possible a 400 watt patch.

Further, there are new processes for increasing the diode efficiency to at least 1% for diodes that operate up to 6 microns. This permits fabricating a patch which has a 400 watt output power from 1 micron to 6 microns. As a result, it is possible to replace DIRCM systems with a composite flexible panel of these patches, each pointing in different directions, in which the composite panels are adhered to the surface of an aircraft or other vehicle.

In one embodiment, 4000 to 1,000,000 small light emitting diodes or LEDs are embedded in flexible plastic which has an adhesive back, such that file card sized patches of diodes are combined into a composite panel that is adhesively attached to the exterior of an aircraft, with the large numbers of diodes in the patch generating as much radiation per steradian as a laser. The reason that this is possible is due to the large number of diodes in a conformal area that generates an amount of infrared radiation in missile seeker bands comparable to DIRCM systems without having to use laser and laser scanning heads.

Thus, each of the diodes in the patch is modulated with a jamming code that will spoof the incoming threat. In another embodiment, a series of diodes having different spectral outputs is embedded in the plastic sheet such that the diodes are addressable to provide the countermeasure device with a spectral emission tailored to the specific threat involved. Thus, a composite panel can be switched to provide outputs which are tailored to countermeasure a specific threat. Such a multi-spectral response is not possible with DIRCM heads, namely because it would require the location of for instance 30 DIRCM heads on a aircraft in order to provide the flexible multi-spectral response of the subject system.

Secondly, the adhesive composite panels may be located about the fuselage of the aircraft and may be blinked or sequentially driven so that the speed of the aircraft appears to an incoming missile to be other than what it actually is. This will cause the missile guidance electronics to calculate a target intercept point which is different from that of the actual target.

It is noted that the diodes in the flexible sheet may be either used as is or provided with corresponding lenses to focus the energy from the diode arrays in the flexible sheet. With appropriate lenses diode emitters will have a field of view of 3.6°, such that with a composite panel of 9×9 patches one can cover 30°. With a small array of such composite panels about the aircraft close to spherical coverage may be obtained. When limited numbers of composite panels are used, 360° coverage in the horizontal plane can be achieved with a 30° down looking angle fore and aft of the aircraft, assuming no composite panels that face straight down.

Since most missiles come in at a shallow angle as they approach the engines of the aircraft, it is highly unlikely that a missile will be coming directly up at the aircraft itself. However, if protection is required under the belly of the aircraft, additional composite panels can be cemented on the bottom of the aircraft.

Thus, one could have an ensemble of from 1 to 100 composite panels on the airplane, with the patches in the composite panel radiating a fan of infrared energy using diodes embedded in a flexible sheet.

The process for embedding the diodes can involve a print process in which the diodes are distributed in the plastic.

Typical diodes have an output of 20 milliwatts at the start of the infrared band, around 1 micron. However, the output degrades down to 100 microwatts around 6 microns. Experimental diodes having a 1 mW output at 6 microns have been made using electron beam lithography. These diodes are available from the Army Research Laboratory as reported by Das et al. April Phys. Lett. 87,041106 (2006); Proc. of SPE Vol. 6942, 694201 (2008); IEEE Trans, Electronics Packaging mfg. Vol. 32 No. 1 (January 2009); and Intl. Quantum Electronics conf. CLEOE-IQEC (2007).

The patch dimensions are designed so that a sufficient number of diodes are utilized to produce a 400 watt output at the surface of the patch. Moreover, the spectral characteristics of the patch can be varied such that one can mix the diodes both as to color and as to density to tailor the patch to the desired output.

Note also that focusing techniques can be utilized to focus the outputs of the diodes, making the patches somewhat more directive. If such is the case, then while intensifying the output of the patches, one may have to utilize more composite panels to provide the desirable spherical coverage. When the diodes are provided with lenses and the composite panels are adhered to the skin of the aircraft, a normal vector of at least one patch in the composite panel points towards an incoming missile in the 30° field of view of the composite panel. Moreover, the direction of the patch output may be influenced by the use of tectonic crystal substrates or luminous technologies so as to intensify outputs in a predetermined direction.

One can also use MEMS to point the lenses and steer beams at the cost of more complexity. However, the MEMS technique saves considerably on panel cost.

The desired goal is to achieve a 100 kW per steradian output. This is equivalent to a 400 watt patch focused into a 3.6° beam. In one embodiment, in order to cover 30°, nine side-by-side patches are combined into a composite panel, the composite panels have their diode axes offset by 3° such that they are aimed in different directions and fan out in nine side-by-side 3.6° beams to make up a composite 30° coverage angle.

As part of the subject invention, one provides flexible conformal patches of arrays of diodes in which the number of diodes and thus the size of the patch determines the infrared output of the patch. Thus, with enough light emitting diodes it is possible to achieve the desired 400 watt output for the patch. Note, by arraying the patches, a flexible composite panel can provide the 100 kW steradian output over 30°.

Moreover, the light emitting diodes may be distributed so that they mimic the thermal signature of a jet engine. This is unlike lasers that have a characteristic signature. It is possible that seekers can be made intelligent enough to recognize the spectral signature of a laser and to reject laser illumination as opposed to radiation that comes from a jet engine. It is therefore a feature of the subject invention to provide an LED distribution in the composite panels to make the panel outputs look exactly like the output of a jet engine.

It will be appreciated that each individual diode has an output from about 1 to 50 milliwatts. Thus, for a 400 watt patch there may be between 8,000 and 400,000 diodes in the patch. Note that 400,000 diodes at 1 milliwatt would be equivalent to 400 watts of output power. For 50 milliwatt diodes, one uses 800 diodes. Due to miniaturization of the diodes and the type of arrays that are presently available, having 100,000 or more diodes in a patch of small size is clearly within the state of the art.

While diodes are considerably more powerful in the 1 micron range, the outputs of these diodes tail off above 1 micron. Thus, for instance at 4 microns one needs to have more diodes to provide the required 400 watt output. However, most jet engines do not have 4 micron outputs but rather have peak radiation at about 2 microns.

Regardless, with a wide variety of diodes in a panel and being able to address them individually, one can activate or light up the diodes that are required for any particular spectral response. Thus, it is not required that all of the diodes in the panel be actuated at one time.

The patches may be driven with a 1-10 kilowatt DC source which may be either continually on to provide continual protection for the aircraft, or the patches may be turned on responsive to a detected threat.

Additionally, the patches may be driven hot and placed on the wing tips of an aircraft such that the incoming missile, if not countermeasured, homes in on the tip of the aircraft wing as opposed to the engines of the aircraft. It has been demonstrated that when some heat missiles attack and have detonated their explosive charges at the tip of an aircraft wing, the resultant damage was slight and flight could be continued.

Moreover, due to the addressable nature of the patches as well as the ability to sequence the composite panels, one can sequence multiple composite panels in the field of view and blink them so as to walk the missile around and away from the targeted aircraft.

It is noted that one can control the patch output power by varying the spacing of the diodes and that the power density of the panel may be made a function of the different wavelengths and how many diodes are utilized.

This being the case mid-wavelength infrared diodes that do not perform well at for instance 4 microns may either not be used, or present techniques for increasing the infrared output of such diodes may be employed. These techniques include for instance doped superlattice techniques which returns the efficiency of the diode back to approximately 1%.

Note that the composite panels in at least one embodiment are simply crudely directing energy to attack an incoming threat and need not be focused directly on the missile head. This is distinguished from laser systems that require accurate pointing gimbals to put enough laser energy on target.

Also, modulating the diodes is less of a chore than modulating laser outputs for high intensity lasers, making it a relatively simple matter to impart a particular jamming code to the radiation.

In summary, what is provided is an electronic countermeasure product that uses flexible packaging of diodes to replace flares, lamps and directed lasers.

More particularly, an adhesively affixed LED composite panel is driven to provide infrared jamming radiation to countermeasure incoming heat-seeking missiles.

BRIEF DESCRIPTION OF THE DRAWINGS

These and other features of the subject invention will be better understood in connection with the Detailed Description, in conjunction with the Drawings, of which.

DETAILED DESCRIPTION

Figure 1:
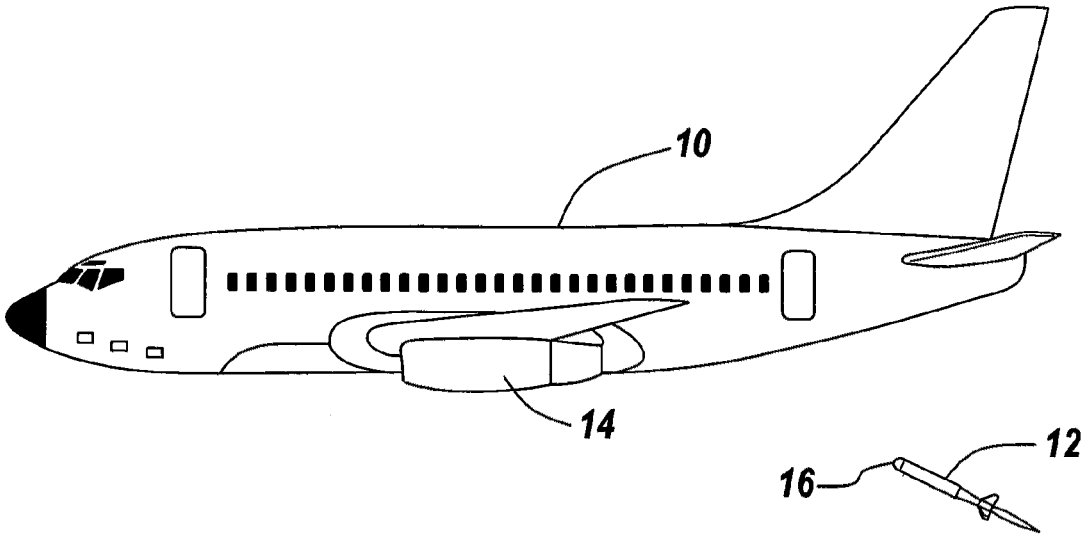
FIG. 1 is a diagrammatic illustration of the attack of a commercial airliner by a heat-seeking missile.

Referring to FIG. 1, a commercial aircraft 10 is shown being attacked by a heat-seeking missile 12 which usually is in the form of a manpads shoulder-fired missile that is launched from a land-based position towards the aircraft and which hones in on the heat generated by an engine 14 of the aircraft. The infrared heat-seeking missile has a seeker head 16 in which electronics detect heat generated by the engines of the aircraft, track the aircraft and provide an intercept point to which the missile is directed.

These inexpensive shoulder-fired missiles are a threat not only to commercial aviation, but to military aviation and in fact to land-based devices and facilities.

Figure 2:
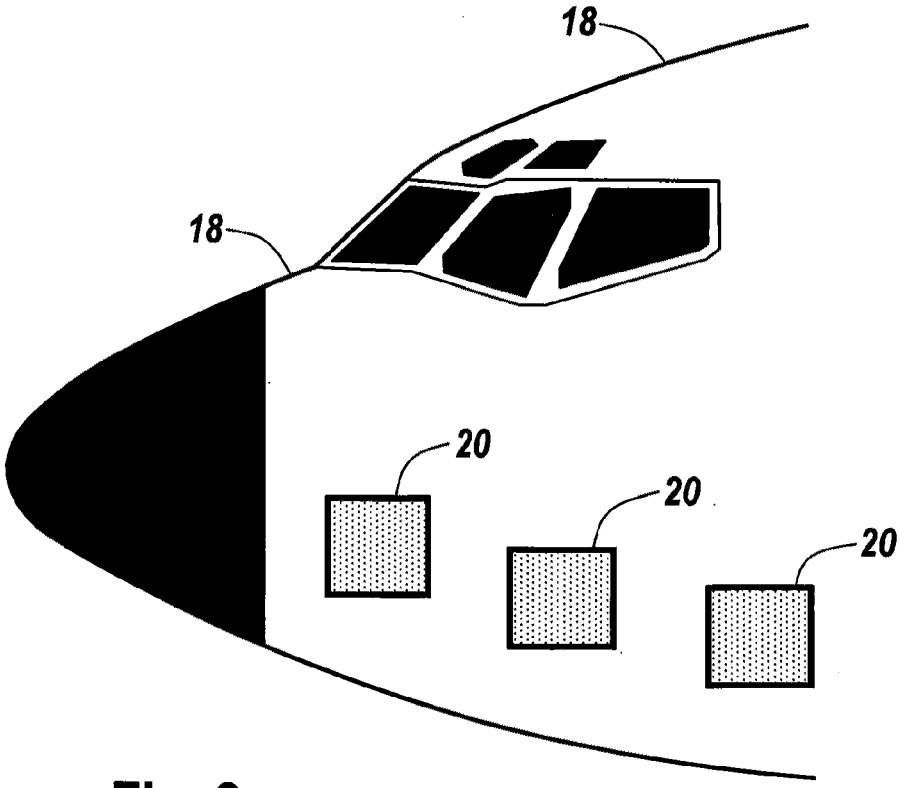
FIG. 2 is a diagrammatic illustration of the nose of the aircraft of FIG. 1 illustrating the placement of composite panels on the nose thereof which are driven to emit infrared radiation for countermeasuring the missile of FIG. 1.

As mentioned, in the past these heat-seeking missiles are countermeasured by DIRCM devices, infrared radiation producing lamps, or flares, all of which are problematic either as to deployment or as to usage Referring to FIG. 2, the nose 18 of aircraft 10 is provided with a number of the subject composite panels here illustrated at 20 driven to emit infrared radiation in the spectral band associated with the head of the heat-seeking missile 12 of FIG. 1.

Composite panel 20 has individual patches provided with a sufficient number of light emitting diodes or LEDs such that effective radiating power at the surface of a panel is 400 watts. This translates, as will be seen, to an effective on-target jamming radiation power of 100 kW per steradian.

Figure 3:
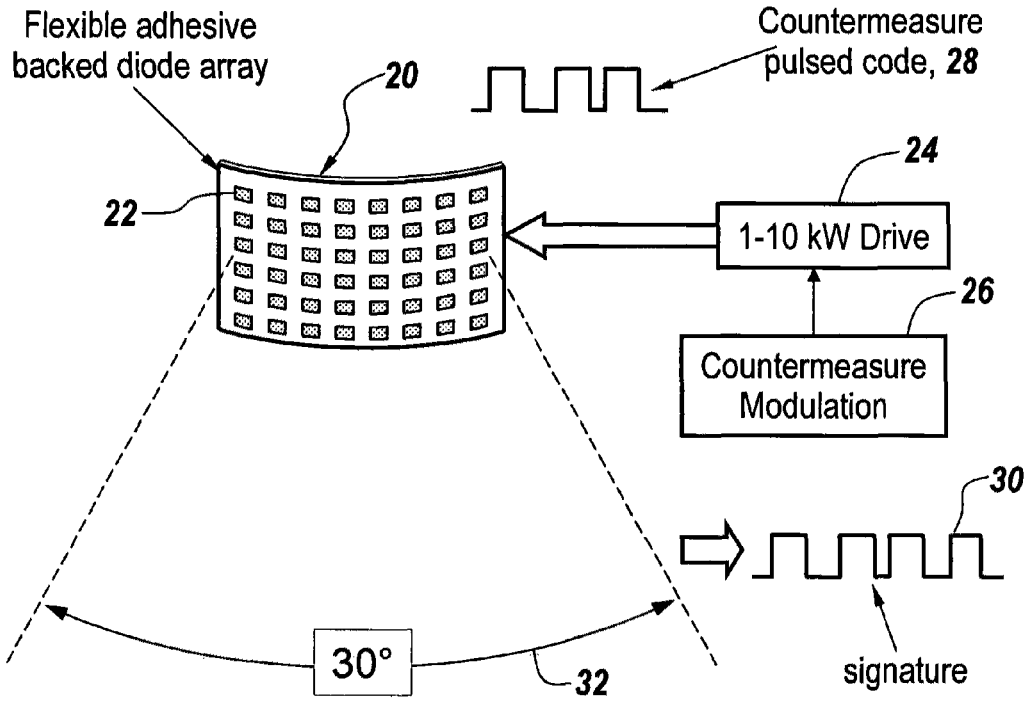
FIG. 3 is a diagrammatic illustration of the composite panel of FIG. 2 illustrating the driving of a flexible adhesive-backed diode array patch with a 1-10 kilowatt DC drive that has been modulated with a pulse code designed to countermeasure an incoming missile.

Referring to FIG. 3, composite panel 20 includes an array of flexible adhesive backed diode array patches 22 having diodes positioned thereon. These diodes are driven in one embodiment with a 4 kilowatt DC drive 24 which is modulated in accordance with countermeasure modulation 26 to produce a jam code 28 for the radiation emitted form panel 20.

Composite panel 20 contains a nominally 9×9 array of subpanels or patches, each containing a diode array. Each diode is covered by a lens directing the subarray in a specific angular direction in a manner similar to how stadium lights or stage lights are directed at a specific patch of the area to be illuminated. The nominal size of each patch is a 3.6×3.6 degree square. Through this level of directivity, each patch attains a angular power density of 100 kW/Sr when radiating 400 W.

The net result is a signature 30 comprising the jam code which is projected in the far field over a coverage angle of 30×30° as shown by double ended arrow 32.

It has been found that sufficient light is available in the infrared region of the electromagnetic spectrum to in fact produce enough energy on target to countermeasure an incoming missile that is provided with an infrared seeker.

Figure 4:
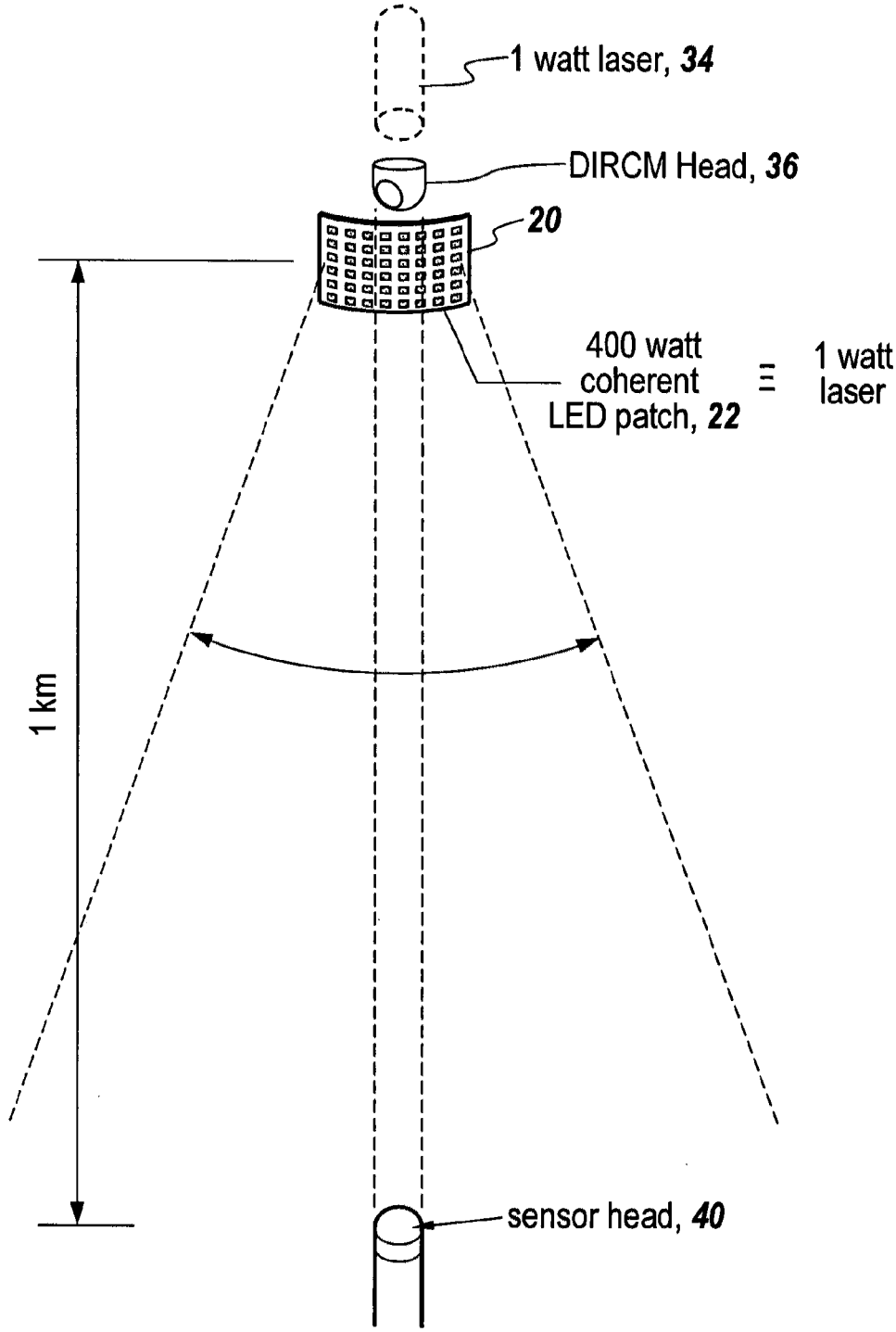
FIG. 4 is a diagrammatic illustration of the field of view of the composite panel of FIG. 3 illustrating that at for instance 1 kilometer the amount of energy impinging on the missile's tracker head is equivalent to the collimated energy from a 1 watt laser aimed at the tracker head.

Referring to FIG. 4, it can be seen that each patch 22 develops a 400 watt coherent LED output which is equivalent to the output of a 1 watt laser, here shown at 34. As shown in the past, the output of the laser was directed by a DIRCM head 36 to aim the laser beam 38 to illuminate missile head 40 with collimated beam 42.

A 1 W laser produces approximately 100 kilowatts per steradian energy which is contained within beam 42 on missile head 40.

It has been found that each of the patches 22 making up composite panel 20 has a 3.6° field of view and produces the same amount of energy as a 1 W laser on head 40, with the 400 watt coherent LED radiation providing a viable substitute for the directed laser system shown.

Figure 5:
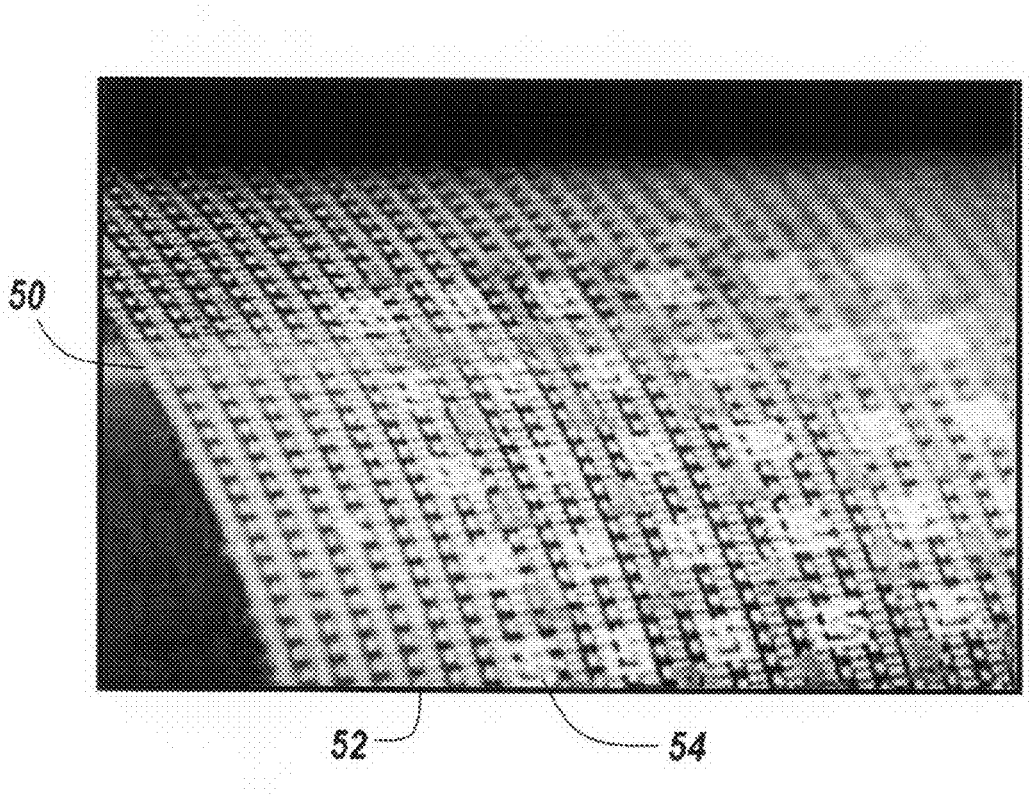
FIG. 5 is a picture of a flexible patch illustrating the placement of individual diodes on the surface of the flexible adhesive-backed sheet.

Referring to FIG. 5, what is seen is a flexible sheet 50 which is adhesive-backed and contains a number of individual diodes 52 and controls circuits 54 that can be utilized to address selected diodes.

Figure 6:
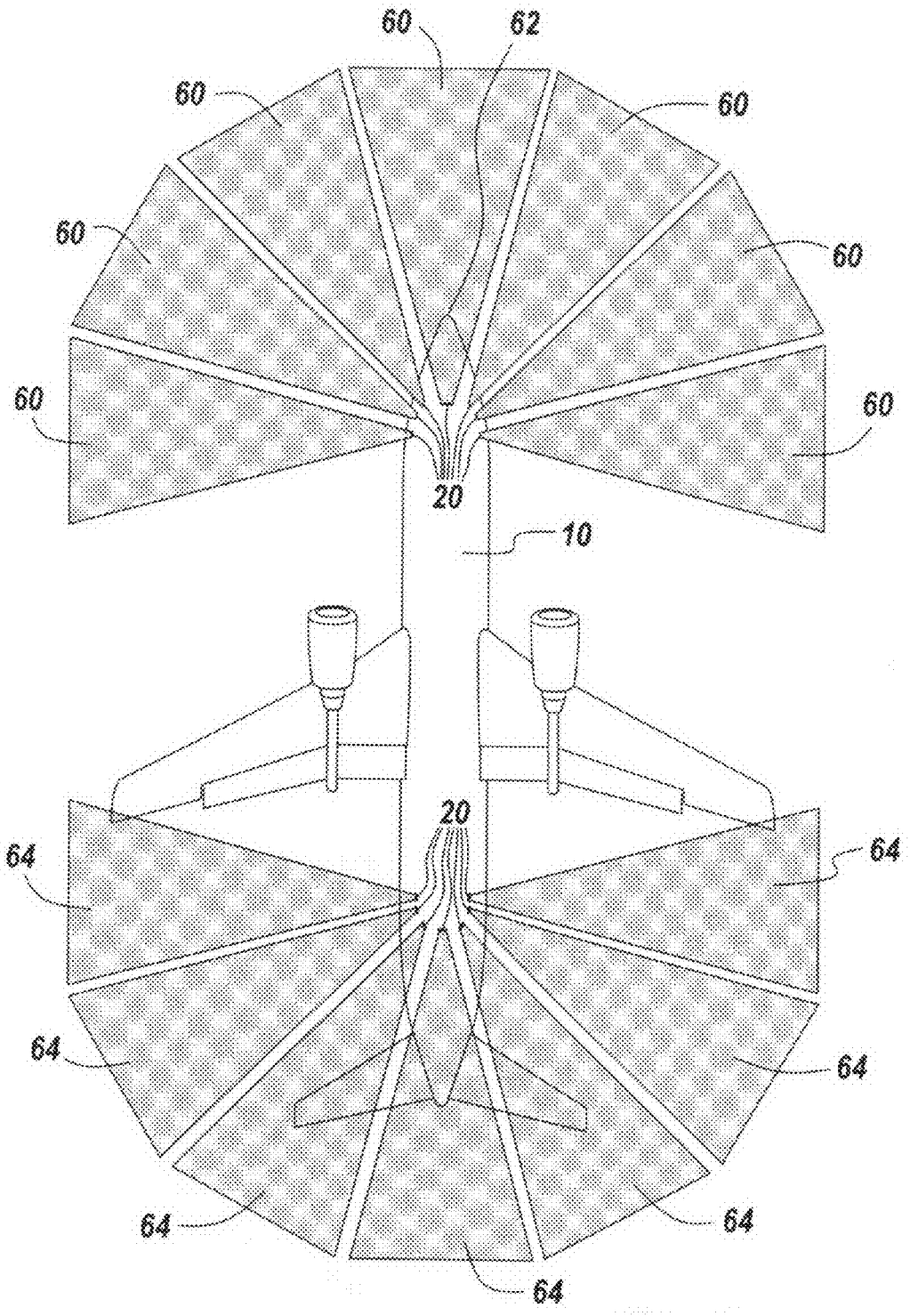
FIG. 6 is a diagrammatic illustration of the coverage for a commercial airliner provided with a number of flexible composite panels, illustrating 360° coverage in a horizontal plane.

Referring to FIG. 6, commercial aircraft 10 can be provided with a number of composite panels 20 having a field of view or coverage illustrated by segments 60 about the nose 62 of aircraft 10, whereas segments 64 provide aft coverage as illustrated.

It will be appreciated that the coverage is virtually 360° in the horizontal plane surrounding aircraft 10.

Figure 7:
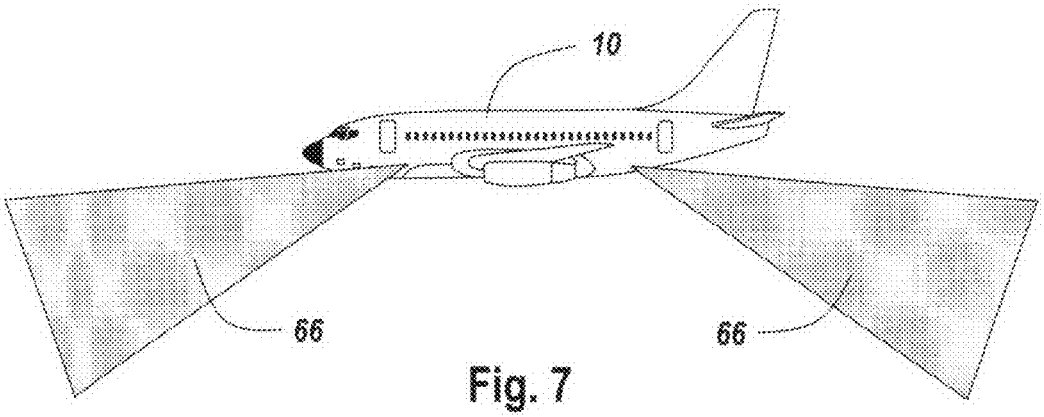
FIG. 7 is a side view of the aircraft of FIG. 6 illustrating down looking coverage fore and aft of the aircraft.
Figure 8:
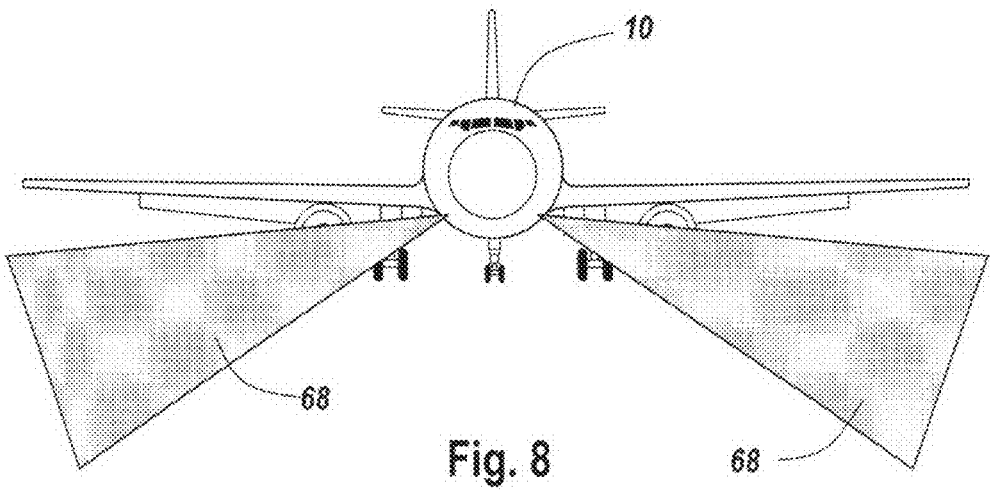
FIG. 8 is a front view of the aircraft of FIG. 6 illustrating port and starboard down looking coverage for the composite panels on the aircraft.

As illustrated in FIG. 7, aircraft 10 utilizing these composite panels is provided with a down looking radiation pattern 66 fore and aft of aircraft 10, usually subtending a 30° angle from the horizontal, whereas as illustrated in FIG. 8, lateral port and starboard down looking coverage 68 is provided again in a down looking 360° configuration.

It will be noted that directly under the aircraft there is no coverage in this embodiment. This is not a problem due to the unlikelihood that a missile will approach the aircraft directly from beneath. As mentioned hereinbefore, additional composite panels can be located on the belly of the aircraft to protect the aircraft from a missile coming up directly from underneath the aircraft.

Figure 9:
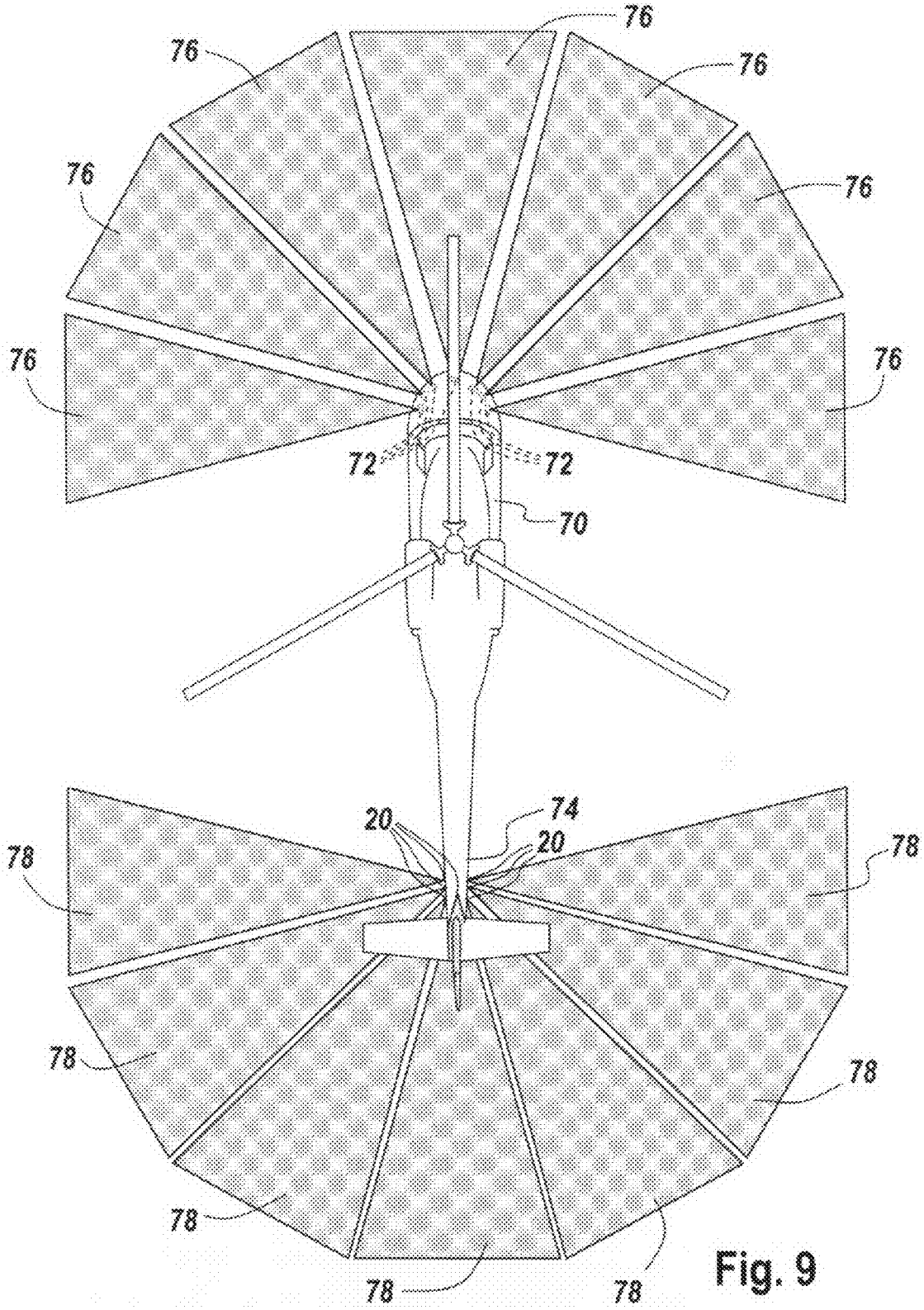
FIG. 9 is a diagrammatic illustration of the horizontal coverage of a helicopter for composite panels located on the nose and the tail of the helicopter.

Referring now to FIG. 9, a helicopter 70 may also be provided with coverage utilizing composite panels 20 at the nose of the helicopter 72 and at the tail of the helicopter 74, with forward horizontal coverage being illustrated by segments 76 and with aft coverage being illustrated by segments 78.

Thus, by utilizing 14 extremely inexpensive composite panels one can achieve 360° horizontal coverage for a helicopter.

Figure 10:
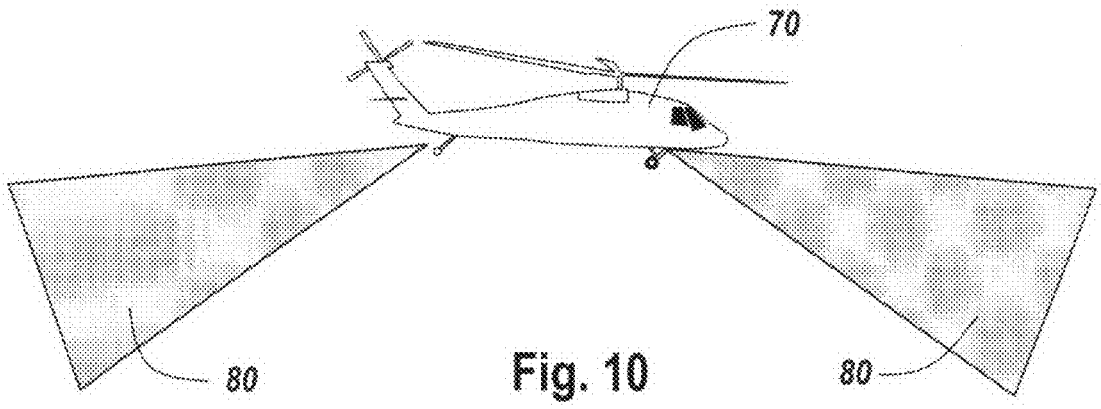
FIG. 10 is a side view of the helicopter of FIG. 9 showing the down looking coverage fore and aft.
Figure 11:
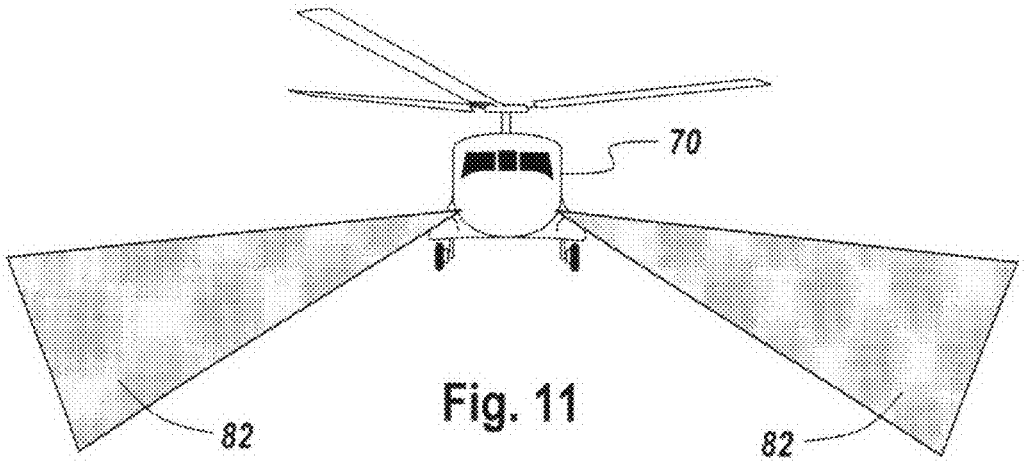
FIG. 11 is a diagrammatic illustration of the coverage for the helicopter of FIG. 9 showing port and starboard down looking coverage.

Referring to FIG. 10, the down looking radiation pattern is illustrated by segments 80, whereas referring to FIG. 11, lateral port starboard pattern is illustrated by segments 82.

It will be appreciated that in the case of a helicopter and in fact small drone aircraft, rather than having to mount a DIRCM head and attendant laser circuitry on the aircraft, a lightweight system is provided which can be readily retrofitted to any helicopter or drone in order to protect the helicopter or drone from shoulder-fired missiles. In this case, the directed energy requirement will be substantially less than 100 kW per steradian and the panels will be smaller.

Figure 12:
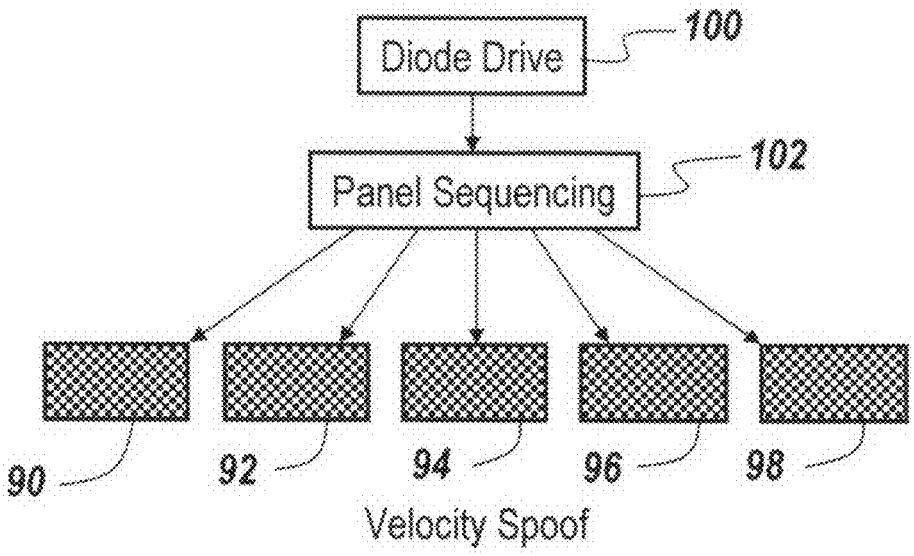
FIG. 12 is a diagrammatic illustration of the utilization of multiple composite panels which are sequenced to provide velocity spoofing of an incoming missile.

Referring to FIG. 12, what is seen is a number of composite panels 90, 92, 94, 96 and 98 connected to a diode drive 100, with a composite panel sequencing and addressing switching system 102 that is able to blink or sequence the composite panels, thus to provide radiation that would indicate that the speed of the aircraft is other than what it actually is.

Figure 13:
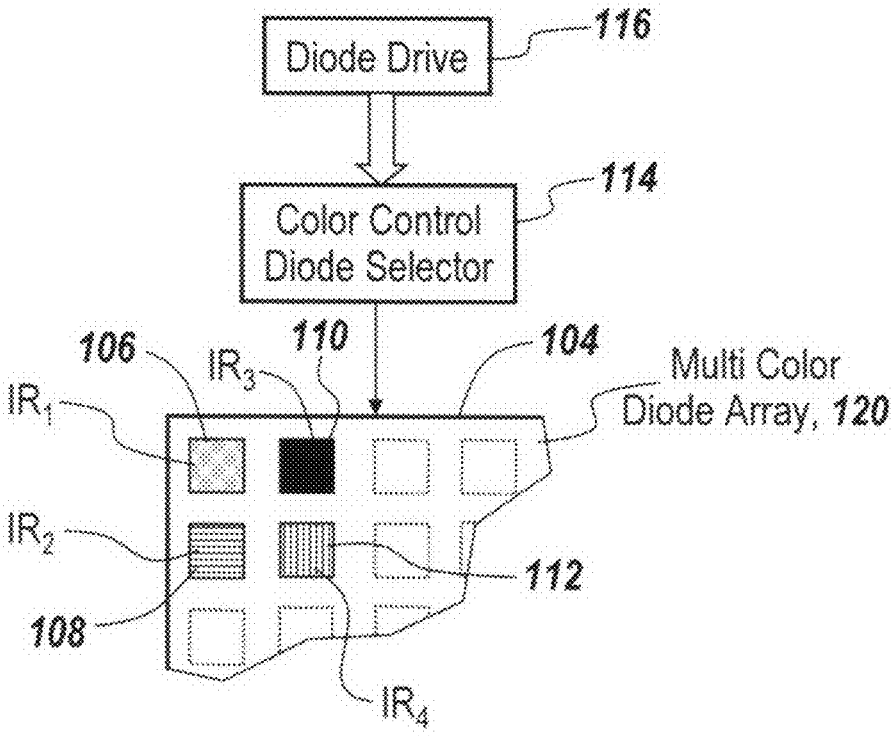
FIG. 13 is a diagrammatic illustration of the utilization of a multi-colored diode array patch having individually addressable differently-colored diodes, with a color control selector utilized to address selected ones of the multi-colored diodes in the array.

Referring now to FIG. 13, a patch 104 in a composite panel is provided with differently colored light emitting devices 106, 108, 110 and 112, with the individual diodes being addressable through a color selector 114 driven by a diode drive 116.

In this case diode array 120 is a multi-colored diode array such that the spectral output of the array can be tailored to any one of a number of tactical situations. Not only can the color of the display be selectively switched, the density of the activated diodes can be altered by selectively activating only certain diodes. This is useful, for instance, when going from for instance a 1 micron output in which all diodes might be activated to, for instance, a 2 micron output in which only selected specially-configured high efficiency diodes are activated.

The availability of light emitting diodes in the range of 1 micron to 6 microns is accomplished through the utilization of standard light emitting diodes for the 1 micron region such as manufactured by Roithner Laser, whereas the 2-3 micron region may be adequately serviced by light emitting diodes fabricated using the technique described in Das et al, IEEE Transactions on Electronics Packaging Manufacturing Vol 32 No 1 Jan. 2009 page 9 by the Army Research Laboratory which operate at efficiencies on the order of 1%. It will be appreciated that even though the diodes are not operating at a theoretical maximum of 10% efficiency, assuming enough diodes at 1% are actuated then the patch will have the 400 watt output capability to provide the 100 kilowatt per steradian intensities required for countermeasuring purposes.

Alternatively, a specialized process described by Das et al. provides adequate mid-IR capabilities for diodes utilizing the doped superlattice design and an electron beam lithography fabrication technique. As a result, light emitting diodes whose outputs normally would degrade significantly as the wavelengths lengthen, are nonetheless made powerful enough to be used in a reasonable-sized panel with a reasonable amount of drive power to satisfy the 100 kilowatt per steradian requirement.

Figure 14:
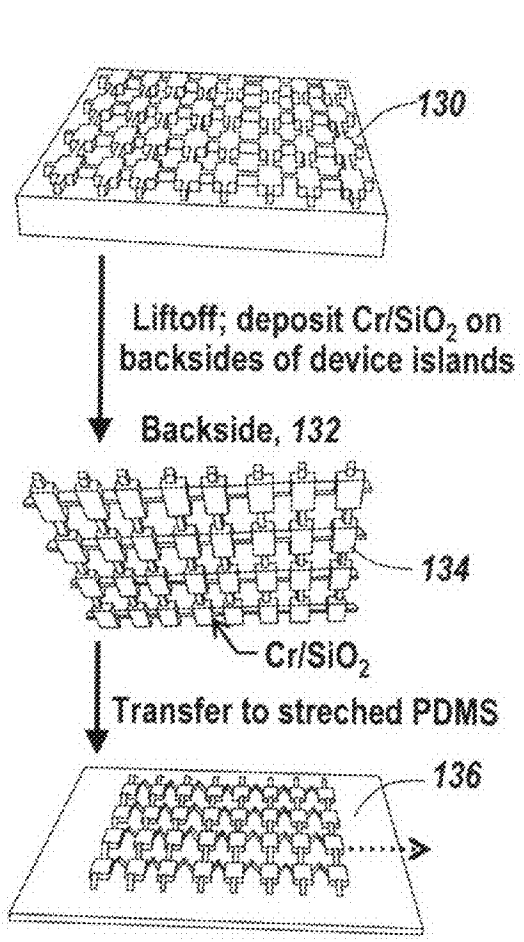
FIG. 14 is a diagrammatic illustration of the fabrication of a multi-spectral flexible array patch in which a micro-transfer printing process is used incorporating a stamp transfer process in which wafer produced devices are undercut with a controlled edge that leaves them attached with only small tags, with a soft PDMS stamp then brought in contact with the wafer in a step and repeat process which can disperse the devices on a receiving substrate; and, FIG. 15 is a diode source chart.
Figure 14:
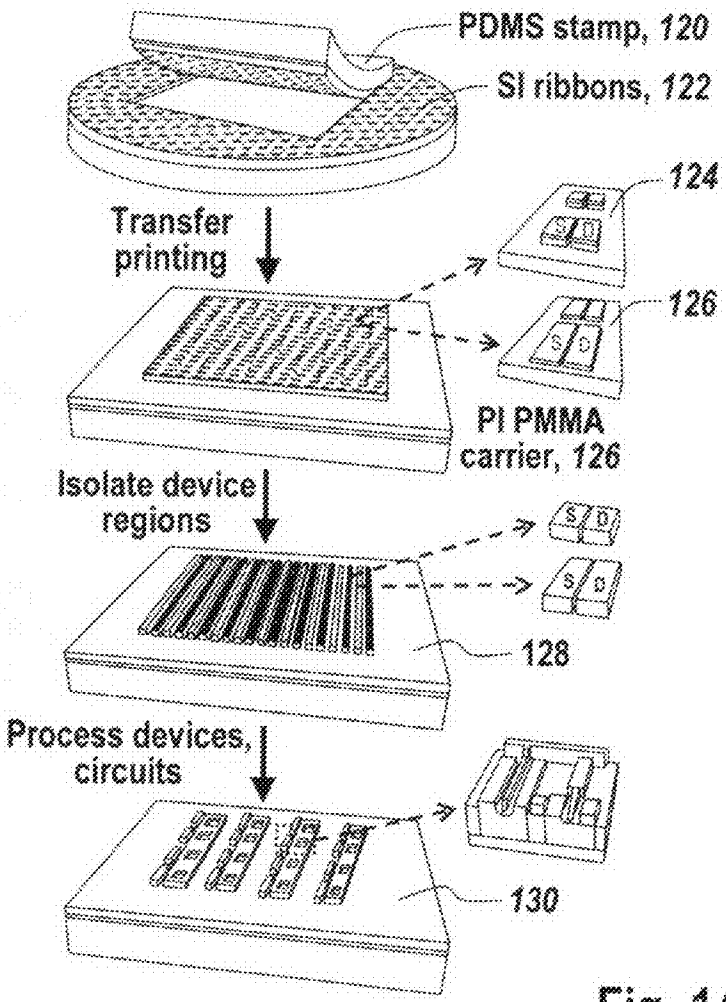

Having been able to fabricate the necessary diodes and referring to FIG. 14, a stamping process is utilized to stamp diodes onto a flexible adhesively backed substrate by a transfer printing process utilizing a polydimethylsiloxane (PDMS) stamp 120 associated with diode ribbons 122 which transfers devices diagrammatically illustrated at 124 onto a polymethyl methacrylate (PMMA) carrier 126. In the process the device regions are isolated as illustrated at 128, with the devices placed on a substrate 130.

Thereafter, the devices on substrate 130 are lifted off and deposited on the backside of device islands 132 such that chromium/silicon oxide devices 134 are transferred to a flexible substrate 136, thus to complete the subject flexible patch.

Referring to FIG. 15, a chart is presented which specifies sources of diodes for use in the subject invention.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. Apparatus for countermeasuring a heat-seeking missile comprising:

a thin flexible plastic lighting source in the form of a panel having one or more patches of light emitting diodes that emit energy in the infrared region of the electromagnetic spectrum;

a power source for the light emitting diodes coupled to said lighting source; and, a modulator for modulating the output of said diodes with a jam code, the number of diodes in said lighting source providing an output commensurate with that associated with an infrared laser countermeasure system.

2. The apparatus of claim 1, wherein each of said diodes has a normal direction along which the majority of energy from said diode is emitted, different diodes having differently angled normals.

3. The apparatus of claim 2, wherein the diodes of said patches are positioned side-by-side in said patch with a normal associated with one diode being skewed with respect to the normal associated with an adjacent diode such that the panel is provided with a combined coverage angle associated with the combined coverage angles of said differently-angled diodes.

4. The apparatus of claim 1, wherein said patches are multi-spectral and include a number of different diodes operating in different regions of the infrared spectrum, and further including an addressing unit for addressing selected diodes.

5. The apparatus of claim 4, wherein said addressing unit selects diodes operating at a predetermined wavelength.

6. The apparatus of claim 4, wherein said addressing unit simultaneously activates all of the diodes in said patch.

7. The apparatus of claim 4, wherein said addressing unit addresses diodes associated with a selected panel and wherein said addressing unit sequentially activates the diodes in adjacent panels so as to countermeasure said missile.

8. The apparatus of claim 1, wherein said patches include diodes having output characteristics which are tailored to simulate the infrared output of a jet engine.

9. The apparatus of claim 1, wherein said panel is used to protect an aircraft and wherein said panel is adhesively attached to the skin of said aircraft.

10. The apparatus of claim 9, and further including adhering a number of panels on the skin of said aircraft such that the coverage angle of said panels in combination provide at 360° coverage for said aircraft in the horizontal direction.

11. The apparatus of claim 10, wherein each of said patches has a coverage angle between 3° and 4° and wherein said panel includes patches, the diodes of which have normals that are offset by said 3° or 4° such that each of said patches has a coverage angle of 30°.

12. The apparatus of claim 11, wherein said patches having a coverage angle of 30° are used in a composite panel, said composite panel being such that said composite panel has a coverage angle associated with the different coverage angles of the diodes in said patches.

13. The apparatus of claim 12, wherein the coverage angle of said composite panel is at least 30°.

14. The apparatus of claim 1, wherein the numbers of diodes in each of said patches provides a light output capable of countermeasuring said missile in a predetermined IR band.

15. The apparatus of claim 14, wherein the numbers of diodes in said patch is proportional to the wavelength of the output of said lighting source.

16. The apparatus of claim 14, wherein the numbers of diodes required for providing a usable output above 2 microns is greater than the number of diodes for producing a usable output below 2 microns.

17. A method for countermeasuring a heat-seeking missile, comprising the steps of:

providing an array of diodes to produce a sufficient amount of non-coherent infrared radiation to countermeasure the heat-seeking missile, said array formed in a flexible patch; and, countermeasuring the missile by driving the diodes with a jam code.

18. The method of claim 17, wherein the flexible patch is adhesively-backed.

19. The method of claim 17, wherein a vehicle or structure is to be protected against heat-seeking missile attacks and wherein the patch is adhered to the surface of the vehicle or structure.

20. The method of claim 19, wherein the vehicle or structure is taken from the group consisting of aircraft, motor vehicles and stationary facilities.

* * * * *